US005516325A

United States Patent [19]

Schunn et al.

[11] Patent Number: 5,516,325

[45] Date of Patent: May 14, 1996

[54] SYSTEM FOR HONING CAMSHAFT CAMS

[75] Inventors: Ingo Schunn; Peter Weiss; Martin Wolters, all of Wuppertal, Germany

[73] Assignee: Ernst Thielenhaus KG, Wuppertal, Germany

[21] Appl. No.: 274,913

[22] Filed: Jul. 14, 1994

Related U.S. Application Data

[62] Division of Ser. No. 93,493, Jul. 16, 1993.

[30] Foreign Application Priority Data

Jul. 31, 1992 [DE] Germany ..... 42 25 259.8
Jul. 31, 1992 [DE] Germany ..... 42 25 260.1

[51] Int. Cl.[6] ..... B24B 7/00

[52] U.S. Cl. ..... 451/163; 451/164; 451/173; 451/174

[58] Field of Search ..... 51/58, 59 R, 67, 51/68, 50 R; 451/143, 163, 164, 173, 174

[56] References Cited

U.S. PATENT DOCUMENTS

| | | | |
|---|---|---|---|
| 921,353 | 5/1909 | Bogert | 51/67 |
| 2,302,105 | 11/1942 | Connor | 51/67 |
| 3,548,546 | 12/1970 | Thielenhoos | 51/58 |
| 3,975,868 | 8/1976 | Botimer | 51/358 |
| 4,501,096 | 2/1985 | Lukianoff | 51/391 |
| 4,505,071 | 5/1985 | Schwär | 51/3 |
| 4,686,794 | 8/1987 | Weber et al. | 51/59 R |
| 4,800,683 | 1/1989 | Schwär | 51/34 E |
| 5,101,601 | 4/1992 | Fonnell | 51/165.77 |

FOREIGN PATENT DOCUMENTS

| | | |
|---|---|---|
| 3011454 | 10/1981 | Germany . |
| 3011455 | 10/1981 | Germany . |
| 3841976 | 12/1988 | Germany . |
| 2248202 | 1/1992 | United Kingdom . |

*Primary Examiner*—Bruce M. Kisliuk
*Assistant Examiner*—Eileen P. Morgan
*Attorney, Agent, or Firm*—Herbert Dubno; Andrew Wilford

[57] ABSTRACT

An outer surface of a cam on a camshaft extending along a camshaft axis is honed by continuously rotating the camshaft about its axis, holding a grinding stone adjacent the cam with a surface of the stone directed radially inward at the cam surface, urging the grinding stone radially of the axis against the stone and thereby pressing the cam surface radially inward against the cam surface for contact of the stone surface along a line with the cam surface, and continuously displacing the stone surface in a direction generally tangential of the camshaft axis and thereby continuously moving the contact line between the cam and stone surfaces. Thus the contact line between the stone and the cam will move continuously, so that wear will not be concentrated in one location and the stone will not wear to fit in surface contact on the cam. The cam surface includes a part-cylindrical base region coaxial with the camshaft and a lobe region projecting radially outward from and joined to the base region. The stone surface is continuously displaced while engaging both of the regions.

5 Claims, 7 Drawing Sheets

FIG. 4
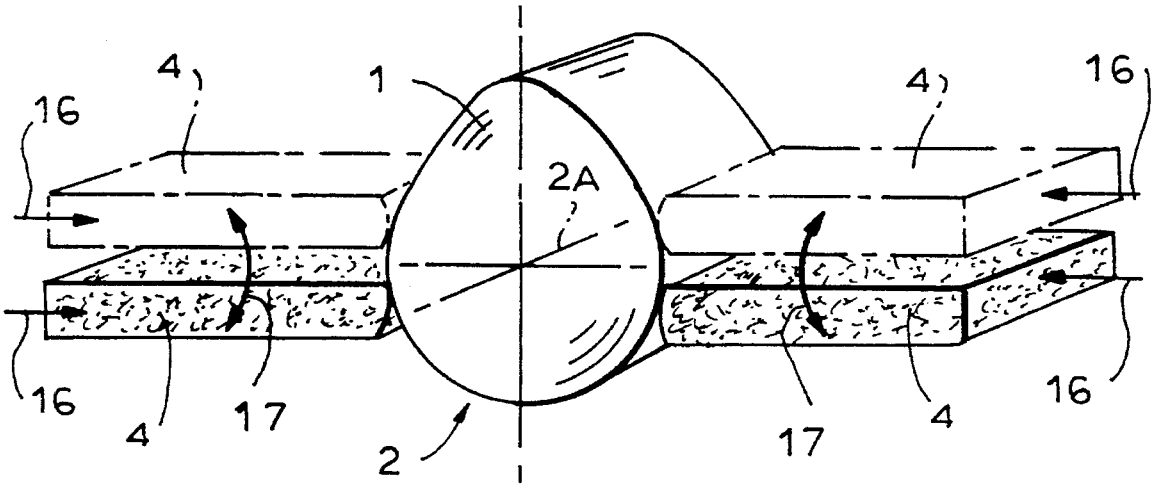
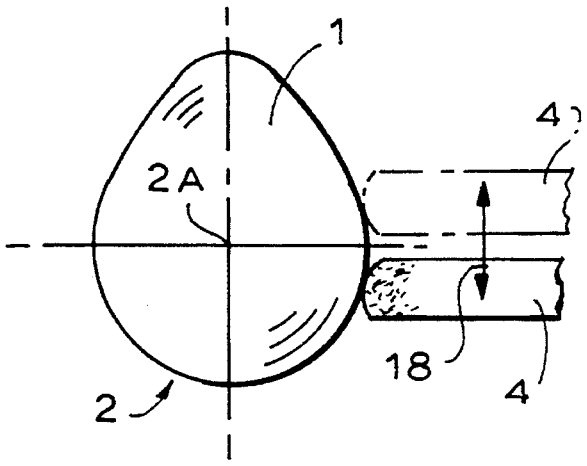
FIG. 5

SYSTEM FOR HONING CAMSHAFT CAMS

This is a divisional of co-pending application Ser. No. 08/093,493 filed on 16 Jul. 1993.

FIELD OF THE INVENTION

The present invention relates to a system for honing the cams of a camshaft. More particularly this invention concerns a method of and apparatus for fine-finishing the lobular cams of a motor-vehicle camshaft.

BACKGROUND OF THE INVENTION

A cam on a camshaft has an outer surface which is normally formed by a part-cylindrical base region that is coaxial with the camshaft and with a lobe region that is eccentric to this axis. These regions must be machined to very tight standards, with the last operation being a honing of the surfaces to a near mirror finish, as in use in a motor vehicle the camshaft rotates at high speed while cam followers ride on the cam surfaces.

The honing operation as described in *Lueger Lexikon der Technik* (Deutsche Verlags, Stuttgart, volume 8 at pages 442 and 443) is carried out by urging fine-grit honing stones radially against the cams as the shaft is rotated about its axis. The stones have surfaces engaging the respective cams and each formed as a family of parallel lines parallel to the camshaft axis. These stones may also be reciprocated axially somewhat during the honing operation.

As described in German patents 3,011,454, 3,011,455, and 3,841,976 two stones are mounted in respective holders on the ends of respective arms at each cam, and these stones are diametrically opposed to each other to prevent the camshaft from being bowed. At the start of the grinding operation each stone surfaces is convex radially toward the camshaft so that it engages the respective cam surface along a contact line extending parallel to the camshaft axis. As the cam is rotated this contact line migrates somewhat on the stone surface as the stone surface engages the lobe region of the cam, but while the stone surface is engaged against the cylindrical base region it does not move at all. Thus in short order the stone wears away at the line where it spends most of its time in contact with the base region and takes on a shape concave toward the camshaft with a part-cylindrical recess on its face of the same diameter as the base region of the cam.

As a result the initially convex face of the grinding stone, which engages the workpiece in line contact and therefore has good material-removal characteristics, becomes a concave face that engages the workpiece in surface contact, with greatly reduced grinding efficiency.

OBJECTS OF THE INVENTION

It is therefore an object of the present invention to provide an improved grinding system for a camshaft.

Another object is the provision of such an improved grinding system for a camshaft which overcomes the above-given disadvantages, that is which retains the grinding efficiency of a new stone, even after substantial use of the stone.

SUMMARY OF THE INVENTION

An outer surface of a cam on a camshaft extending along a camshaft axis is honed by continuously rotating the camshaft about its axis, holding a grinding stone adjacent the cam with a surface of the stone directed radially inward at the cam surface, urging the grinding stone radially of the axis against the stone and thereby pressing the cam surface radially inward against the cam surface for contact of the stone surface along a line with the cam surface, and continuously displacing the stone surface in a direction generally parallel to a plane perpendicular to the radial direction in which the stone is urged against the cam surface and thereby continuously moving the contact line between the cam and stone surfaces. It is to be understood that, unless otherwise stated, all geometric terms such as "radial" or "tangential" are with reference to the camshaft axis.

Thus the contact line between the stone and the cam will move continuously, so that wear will not be concentrated in one location and the stone will not wear to fit in surface contact on the cam. The cam surface includes a part-cylindrical base region coaxial with the camshaft and a lobe region projecting radially outward from and joined to the base region. The stone surface is continuously displaced while engaging both of the regions. The stone therefore stays sharp.

In accordance with another feature of this invention the stone is pivotal about a stone axis offset from the camshaft axis and from the stone surface. The stone surface is displaced by oscillating the stone about the stone axis. It is possible also for the stone surface to be displaced by reciprocating the stone tangentially of the cam surface. When the base region has a predetermined radius, the stone surface is displaced by reciprocating displacement through a stroke having a length generally equal to the radius. Alternately when the camshaft is rotated at a rate, the stone surface is displaced by being reciprocated at a rate that is not equal to a whole-number multiple of the shaft revolution rate, or conversely the stone surface is displaced by being reciprocated at a rate and the camshaft is rotated at a rate that is not equal to a whole-number multiple of the shaft revolution rate. Thus the one rate is never a whole-number multiple of the other, in other words the frequencies are never resonant.

Normally the camshaft has a plurality of such cams spaced axially apart and two such stones are urged oppositely diametrically against each cam. The stone surfaces are displaced by being reciprocated oppositely to each other.

The apparatus for honing an outer surface of a cam on a camshaft extending along a camshaft axis has according to the invention means for continuously rotating the camshaft about its axis, a holder adjacent the cam, a grinding stone in the holder having a surface directed radially inward at the cam surface, and a biasing unit for urging the grinding stone radially of the axis against the stone and thereby pressing the cam surface radially inward against the cam surface for contact of the stone surface along a line with the cam surface. A drive connected to the holder continuously displaces the stone surface in a direction generally tangential of the camshaft axis and thereby continuously moves the contact line between the cam and stone surfaces.

In such an apparatus the stone can be pivotal in the holder about a stone axis offset from the stone surface and from the camshaft axis. The drive is connected to the holder for oscillating the stone about the stone axis. Alternatively the stone surface is generally cylindrical and the stone is rotatable in the holder about a stone axis offset from the stone surface and from the camshaft axis. The drive is connected to the holder for rotating the stone about the stone axis. The apparatus further has an arm pivoted about an arm axis offset from the camshaft axis and from the stone surface and carrying the holder. The drive is connected to the arm axis to move same relative to the camshaft axis and thereby displace the stone surface relative to the camshaft axis. In practice the apparatus has two such arms each carrying a respective such holder and stone. The drive oppositely reciprocates the arm shafts to displace the stone surfaces. The stone can be a block covered by a strip of sand paper, or the paper can be moved over the block to move the stone surface relative to the cam surface.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 4 is a large-scale perspective view schematically illustrating a method of this invention;

FIG. 5 is a large-scale end view illustrating a variant on the method of this invention;

SPECIFIC DESCRIPTION

Figure 1:
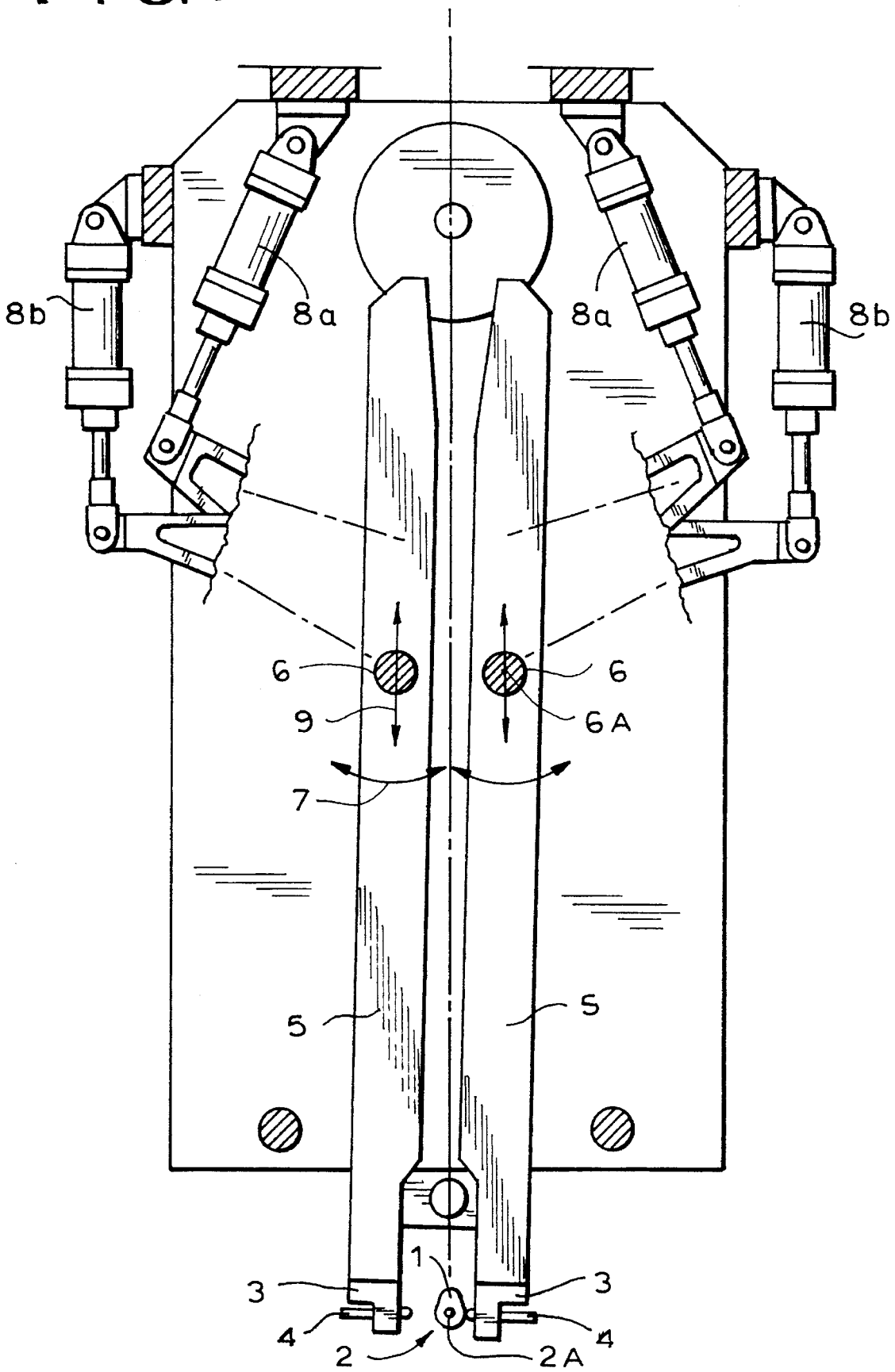
FIG. 1 is a simplified and partly schematic end view of the honing system of this invention.

As seen in FIG. 1 a camshaft 2 extending along a normally horizontal axis 2A carries a plurality of cams 2 that are each engaged radially by a pair of stones 4 carried in holders 3 mounted on the lower ends of respective arms 5 in turn carried on pivotal shafts 6 having pivot or arm axes 6A parallel to the axis 2A. Actuators 8*a* connected to the arms 5 urge the stones 4 radially against opposite sides of the cams 1 as indicated by arrows 7 and further actuators 8*b* can vertically reciprocate the shafts 6 as illustrated by arrows 9.

Figure 2:
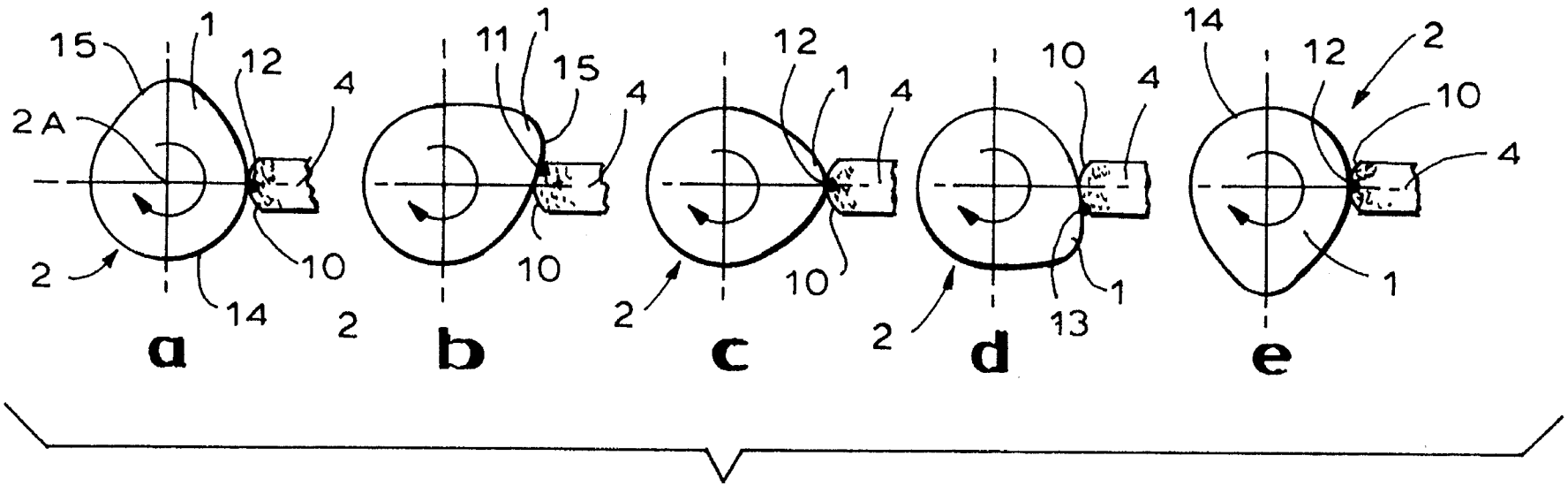
FIG. 2 PRIOR ART
FIG. 2 shows at a through e five stages of grinding in a prior-art system.
Figure 3:
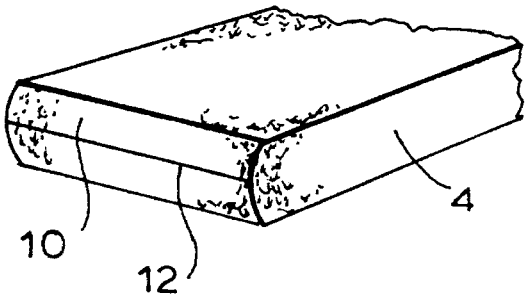
FIG. 3 is a large-scale perspective view of a grinding stone according to the invention.

In the prior art as seen in FIG. 2 the stone 4 has a surface 10 which rides on a part cylindrical base region 14 or a noncylindrical lobe region 15 of the cam 1. To start with as shown at a the surface 12 engages the surface 14 at a centerline 12 parallel to the axis 2A. As it rides up on the lobe region 15 the contact line 11 is moved upward as shown at b, then migrates back to the center as seen at c, and downward to line 13 as shown at d. Once the lobe region 15 is passed contact is again at the center at 12 as seen at e. Since the base region 14 extends over somewhat more than 180°, wear will be concentrated in the center region at line 12, resulting in short order in forming a part-cylindrical concavity in this region. For most efficient grinding (see FIG. 3), line contact is preferred, as line contact gives better results than surface contact.

Figure 10A:
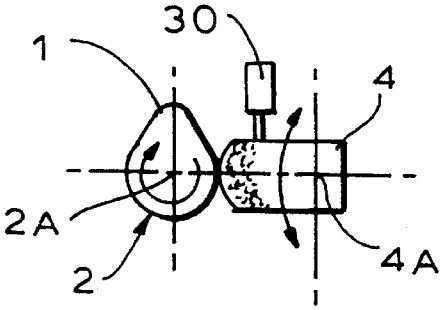

According to the invention such line contact is maintained, and wear at one location is prevented, by moving the contact line between the stone surface 10 and the cam surface 14, 15 even when the stone 4 is engaging the cylindrical surface region 14. This can be done as seen in FIG. 4 by oscillatingly pivoting the stones 4 about axes parallel to but relative far from the axis 2A to create arcuate movement as indicated by arrows 17 in FIG. 4, while the stones 4 are urged inward as indicate by arrows 16. The means for creating the arcuate movement of FIG. 4 has been shown at 30 in FIG. 10A in which the stone 4 is pivotally mounted at 4A. Alternatively, as illustrated in FIG. 5, which is the system of FIG. 1, the stones 4 are each moved in a straight line as indicated at 18 in a direction parallel to a plane (here vertical) including the axis 2A.

Figure 6:
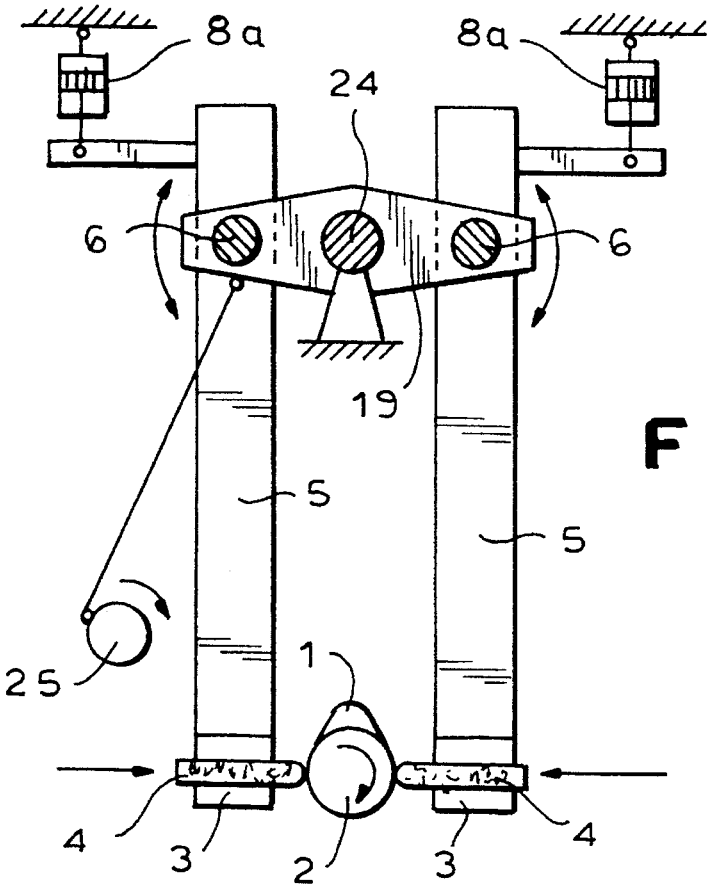

FIG. 6 shows a system for the method of FIG. 5, where the shafts 6 are mounted in opposite ends of a two-arm lever 19 pivoted centrally at a fixed location 24 and continuously rocked by a crank drive 25. Thus as the one stone 4 goes up, the other goes down and vice versa.

Figure 7:
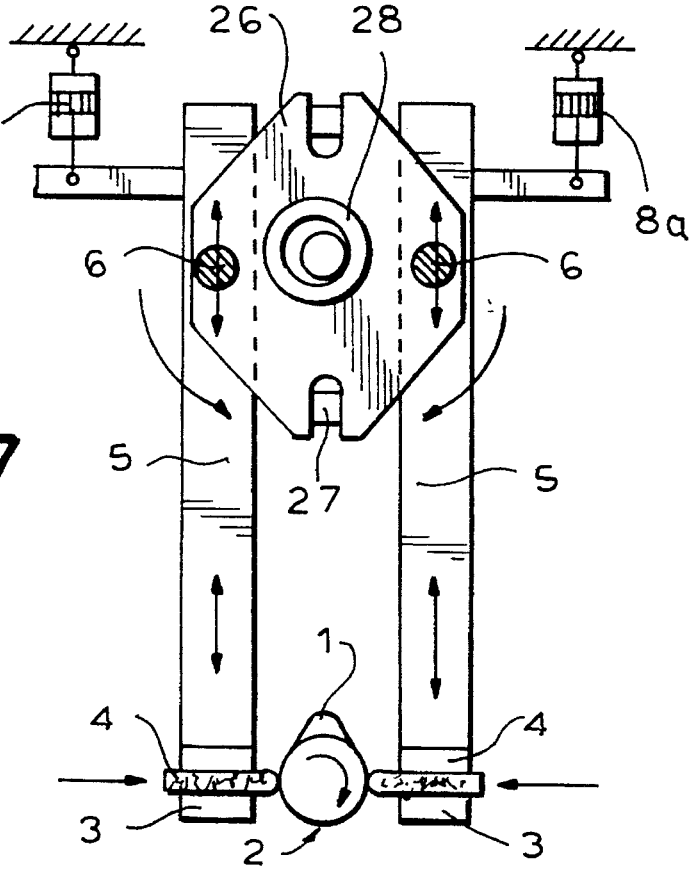

In FIG. 7 the two shafts 6 are mounted in a slide 26 vertically displaceable on guides 27 and centrally engaged by a continuously rotating eccentric 28. Thus the two stones 4 will move synchronously up and down.

Figure 8:
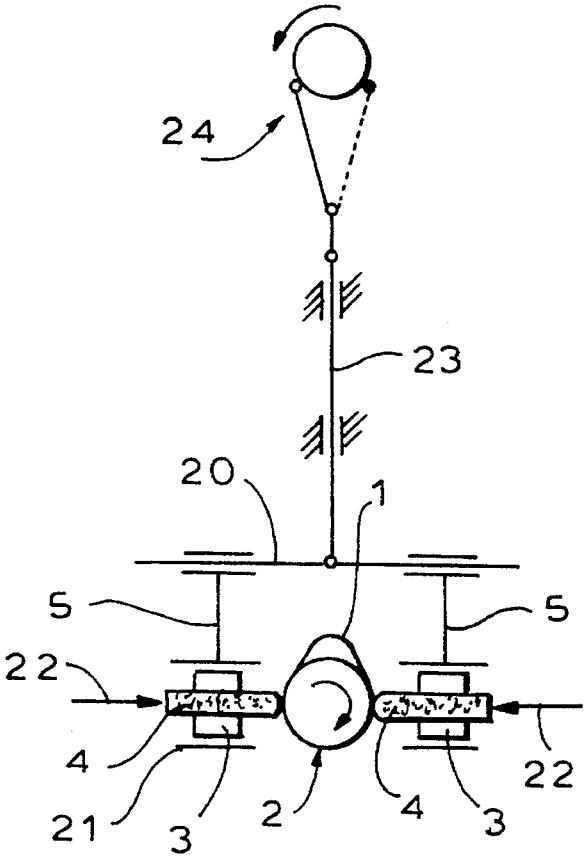
FIGS. 6, 7, 8, 9, and 10 are partly diagrammatic end views illustrating various apparatuses for carrying out the inventive method.

FIG. 8 shows an arrangement where, as illustrated, the holders 3 are only horizontally displaceable in horizontal and radially extending guides 21 and are urged radially inward as indicated by respective arrows 22. The guides 21 are carried on the lower ends of the arms 5 horizontally slidably mounted at their upper ends on a traverse 20 connected via a rod 23 to a crank drive 24. Thus the stones 4 here will be reciprocated identically to those of FIG. 7.

Figure 9A:
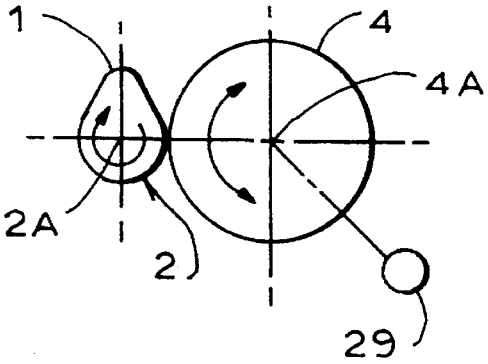
FIGS. 9A and 10A are large-scale views of the details indicated at IXA and XA of respective FIGS. 9 and 10.
Figure 9:
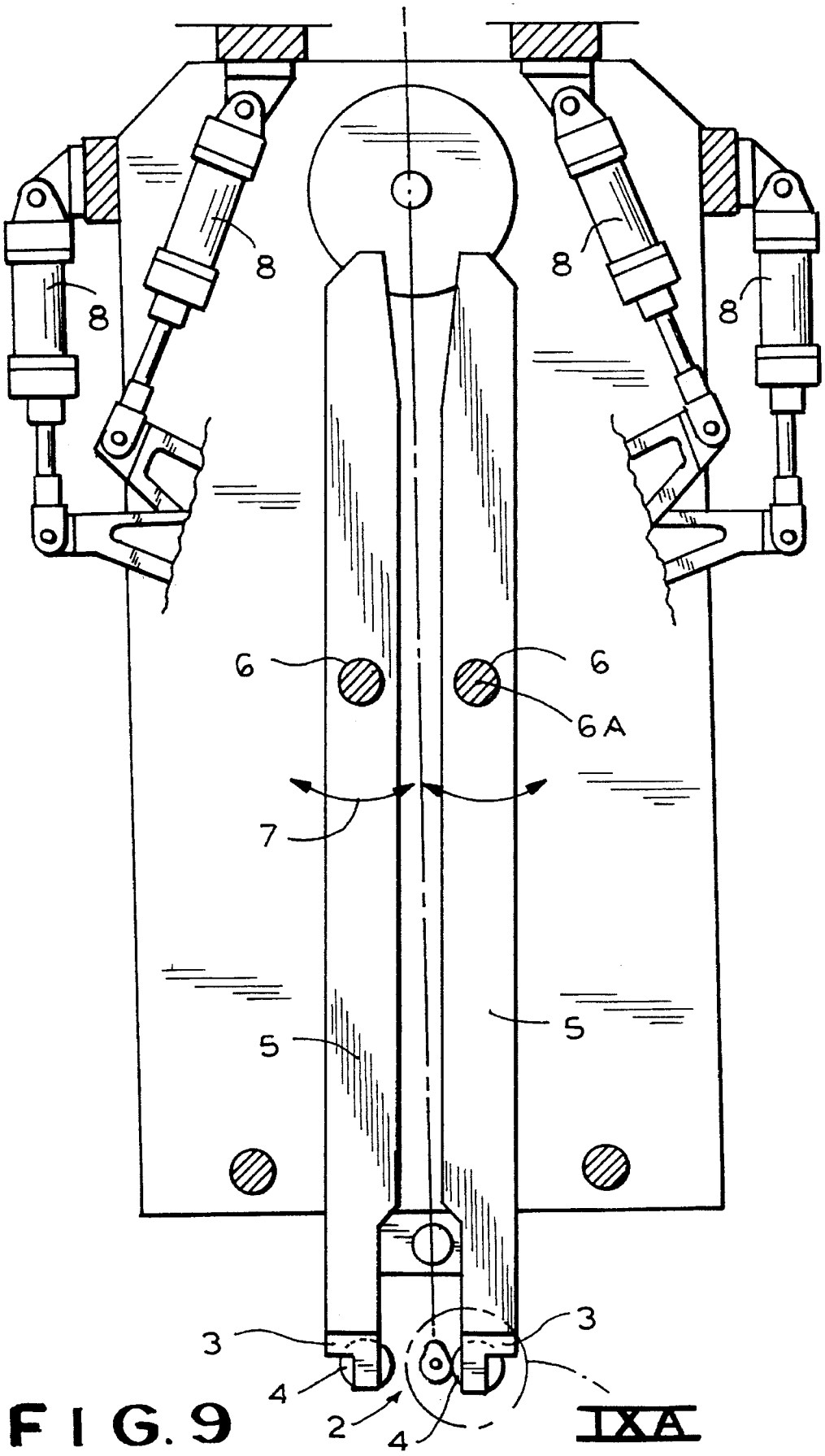

FIG. 9 shows how cylindrical stones 4' can be used that are continuously rotated or oscillated about respective axes 4A by a drive such as indicated schematically in FIG. 9A at 29. The axes 6A of the shafts 6A cannot move relative to the camshaft pivot or arm axis 2A here.

Figure 10:
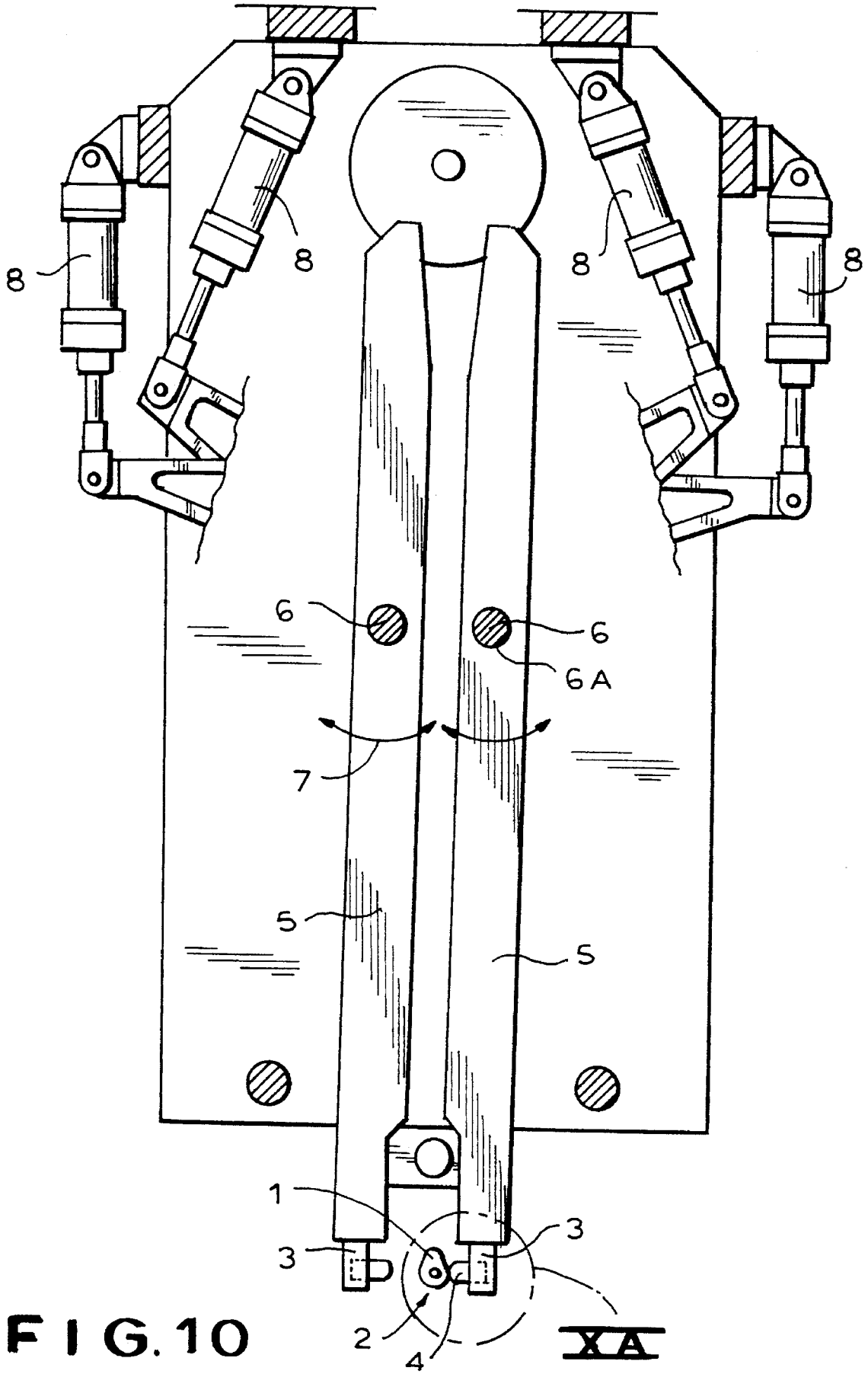

The arrangement of FIG. 10 uses stones 4 that are individually rocked back and forth about their axes 4A (FIG. 10A) by respective drives such as shown schematically at 30.

We claim:

1. An apparatus for honing an outer surface of a cam on a camshaft extending along a camshaft axis, the cam surface being directed radially outwardly of the camshaft axis, the apparatus comprising:

means for continuously rotating the camshaft about the camshaft axis;

a holder adjacent the cam;

a grinding stone in the holder having a surface directed radially inward of the camshaft axis at the cam surface;

biasing means for urging the grinding stone radially of the camshaft axis against the cam and thereby pressing the stone surface radially inward of the axis against the cam surface for contact of the stone surface along a line with the cam surface and for movement of the stone in a biasing radial direction relative to the camshaft axis as the camshaft rotates about the camshaft axis; and drive means connected to the holder for continuously reciprocating the stone surface in a direction generally parallel to a plane perpendicular to said biasing radial direction so the stone surface moves tangentially of the cam surface relative to the camshaft axis and thereby continuously moves the contact line between the cam and stone surfaces along the stone surface.

2. The cam-honing apparatus defined in claim 1, further comprising an arm pivoted about an arm axis offset from the camshaft axis and from the stone surface and carrying the holder, the drive means being connected to the arm at the arm axis to move the arm relative to the camshaft axis and thereby displace the stone surface relative to the camshaft axis.

3. The cam-honing apparatus defined in claim 2 wherein the apparatus has another arm carrying a respective holder and stone, the drive means oppositely reciprocating the arms to displace the respective stone surfaces.

4. The cam-honing apparatus defined in claim 1 wherein the stone is a block covered by a strip of sandpaper.

5. The cam-honing apparatus defined in claim 1 wherein the direction in which the drive means reciprocates the stone is not parallel to the camshaft axis.

* * * * *